US005983792A

United States Patent [19]

Yoshijima et al.

[11] Patent Number: 5,983,792

[45] Date of Patent: Nov. 16, 1999

[54] DEVICE FOR DETECTING MATTERS PRINTED WITH INFRARED RAY REFLECTIVE AND ABSORPTIVE INK

[75] Inventors: Shigetomo Yoshijima, Abiko; Takashi Uemura, Chofu; Seishi Naito, Himeji; Masaaki Hayashi, Himeji, all of Japan

[73] Assignee: Komori Corporation, Tokyo, Japan

[21] Appl. No.: 09/092,310

[22] Filed: Jun. 5, 1998

[30] Foreign Application Priority Data

Jun. 6, 1997 [JP] Japan ..... 9-149059

[51] Int. Cl.[6] ..... B41F 23/00

[52] U.S. Cl. ..... 101/151; 101/171

[58] Field of Search ..... 101/151, 171; 356/244

[56] References Cited

U.S. PATENT DOCUMENTS

| | | | |
|---|---|---|---|
| 4,552,066 | 11/1985 | Giori et al. | 101/152 |
| 4,869,532 | 9/1989 | Abe et al. | 283/88 |
| 5,033,378 | 7/1991 | Ebihara | 101/152 |
| 5,456,498 | 10/1995 | Greene | 283/70 |
| 5,805,280 | 9/1998 | Lasken et al. | 356/244 |
| 5,812,705 | 9/1998 | Wang et al. | 382/294 |
| 5,815,174 | 9/1998 | Stone | 347/19 |
| 5,816,151 | 10/1998 | Wang et al. | 101/171 |

*Primary Examiner*—Edgar Burr
*Assistant Examiner*—Charles H. Nolan, Jr.

[57] ABSTRACT

A device for detecting a printing press for printing a securities printed matter with infrared ray ink of which spectrum characteristics in an infrared region are different from those under white light comprises, infrared ray irradiating means for irradiating infrared ray towards the securities printed matter printed and conveyed, image pick up means for taking an image on the securities printed matter, memory means for previously memorizing the image of a proper securities printed matter printed with infrared ray ink, by irradiating infrared ray, as a standard value, and judgment means for reading out the image memorized in the memory means, comparing an image taken by the image pick up means and the image of the standard value in order to improve an efficiency of quality control of a printing process and detecting process for a printed matter with infrared ray ink and a reliance of a detecting device.

10 Claims, 6 Drawing Sheets rotary encoder reference clock line sensor scan start signal line sensor image signal (output)

A/D conversion timing signal photoelectric switch signal for detecting a conveyed object memory allowable signal memorizing signal

DEVICE FOR DETECTING MATTERS PRINTED WITH INFRARED RAY REFLECTIVE AND ABSORPTIVE INK

BACKGROUND OF THE INVENTION

1. Field of the Invention

The present invention relates to a device for detecting matters printed with infrared ray reflective and absorptive ink, particularly to a device for improving a quality control of a printing press for printing matters with infrared ink against forgery.

2. Prior Art

Recently, technique and skill of a color copy machine and a color DTP are rapidly developed and spread. A technical level of a printing skill is remarkably advanced. Such a trend has promoted a menace of forgery of printed matters such as securities (herein after, it is referred as "securities printed matter") and the menace becomes a serious problem.

On the other hand, in a circumstance of circulating securities printed matters, automatic vending machines and ATMs are spread and a trend of processing money with machines and/or computers by stores and banks has been promoted.

Conventionally, as an anti-forgery method, a main pattern of a securities printed matter is formed of an image with a relief formed by deeply engraved and fine and sharp minute picture lines by an intaglio printing press and a pattern of a ground tint is printed by an offset printing having a fine multi-printing accuracy. A watermark and a safe thread are provided in a sheet of a securities printed matter.

However, a technique of reproducing images is remarkably developed and a money treatment is apt to be automated. It is required to produce securities printed matters with the newest technique against forgery in addition to the conventional technique.

A technique of infrared ray ink is utilized to improve anti-forgery characteristics of securities printed matters by concealing an image printed with the infrared ray ink on the securities printed matters such as securities. Generally, ink that reflects and absorbs near infrared ray is used for printing securities.

Combining ink having the different characteristics produces such ink. The ink have the same reflective and absorptive characteristics in a visible ray region and different reflective and absorptive characteristics in an infrared ray region, respectively.

When printed matters produced by the above technique are shown through an infrared ray image converter capable of converting infrared ray to a visible ray, a shown image is different from an image shown through the naked eyes.

This method can prove that a detected securities printed matter is real. Unless the detected securities printed matter is real, the above phenomenon can not occur.

The quality of securities printed matters, printed with infrared ray reflective and absorptive ink, can not be detected through naked eyes under room light in the production process. For example, in a case where a person determines whether or not the ink is used for printing is correct, patterns are not mixed, and ink is not pale by sampling, the person must pick up some samples and check the printing quality by using an infrared ray image converter placed on a fixed place away from the printing press, while the printing press is working.

However, such a check takes a long time and it is a lazy work.

In view of importance of anti-forgery, this sample checking system is not completely safe.

Particularly, each securities printed matter is usually checked one by one in a negotiation. In a printing process, quality assurance of printed matters is also highly required.

The present invention has been accomplished to resolve the foregoing drawbacks, and the object of the present invention is to provide a highly reliable detecting device by improving quality assurance of matters printed with infrared ray ink in printing and detecting processes.

SUMMARY OF THE INVENTION

To resolve the above drawbacks, the present invention provides a printing press for printing securities printed matter with infrared ray ink, of which spectral characteristics in an infrared region is different from the characteristics under white light. The printing press comprises, means for irradiating infrared ray towards the conveyed securities printed matter and means for taking an image on the securities printed matter irradiated by infrared ray, wherein the printing press further comprises, means for memorizing an image obtained by irradiating infrared ray towards the securities printed matter rightly printed with the infrared ink as a standard value and judgement means for reading out the memorized image of the standard value, comparing the memorized image and the image read out by the memorizing means and judging whether the image read out by the memorizing means is within an allowable range.

BRIEF DESCRIPTION OF THE DRAWINGS

In the following, the invention will be described in more detail with reference to the drawings, and wherein.

DETAILED DESCRIPTION OF THE PREFERRED EMBODIMENT

Reference will now be made in detail to preferred embodiments of the present invention, examples of which are illustrated in the accompanying drawings.

A device for detecting matters printed with infrared ray ink, according to the preferred embodiment of the present invention, employ an infrared ray sensor on a printing press in order to scan a printed surface of each sheet of securities printed matters and monitor the printed surface on line.

The infrared ray sensor may be modified in accordance with its uses and purposes.

Figure 4A:
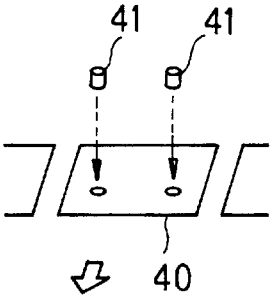
FIG. 4A shows an example of an infrared ray image sensor in a style of a spot sensor.

For example, as shown in FIG. 4A, a spot sensor 41 for detecting a part of a sheet 40 of the securities printed matter (herein after, referred as "security sheet") can be employed. Number of detected regions detected by the spot sensor 41 may be one or more. A location of the spot sensor may be just above an area of the sheet 40 where is cut in a cutting operation.

Figure 4B:
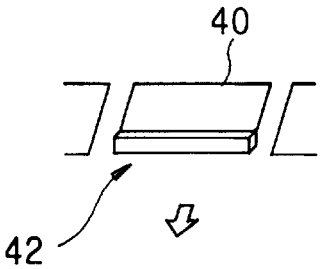
FIG. 4B shows another example of an infrared ray image sensor in a style of a contact type line sensor unit or a CCD line sensor.

As shown in FIG. 4B, a contact type line sensor unit or CCD line sensor 42 may be provided along a transversal direction with respect to a conveyance direction of the security sheet in order to detect the entire surface of the security sheet as the security sheet 40 is conveyed.

Figure 4C:
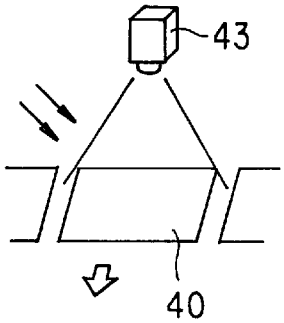
FIG. 4C shows another example of an infrared ray image sensor in a style of an area sensor.

In addition, as shown in FIG. 4C, an area sensor 43, such as a camera located above the sheet 40 with a predetermined distance, may be provided in order to detect the entire surface of the sheet 40 simultaneously. In such a case, infrared ray is irradiated from an inclined direction (in a direction of arrows) with respect to the security sheet 40.

Figure 3A:
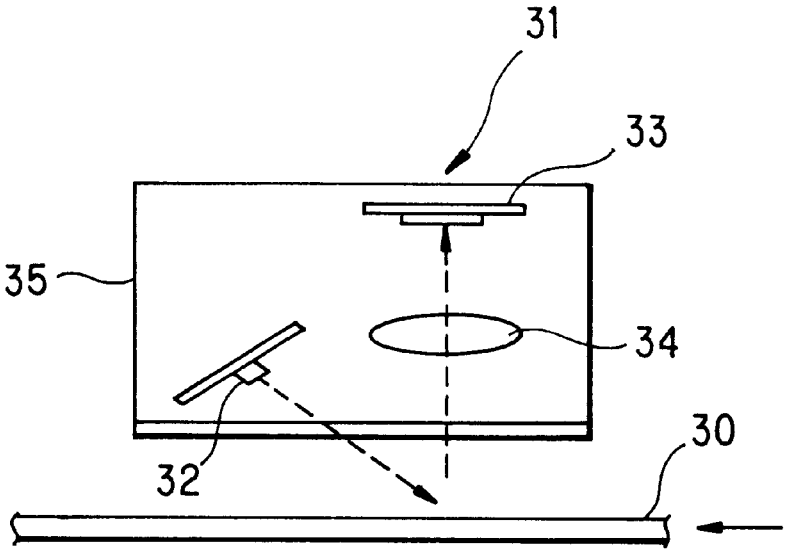
FIG. 3A is a cross sectional view of an application of the embodiment, wherein an infrared ray image sensor is provided.
Figure 3B:
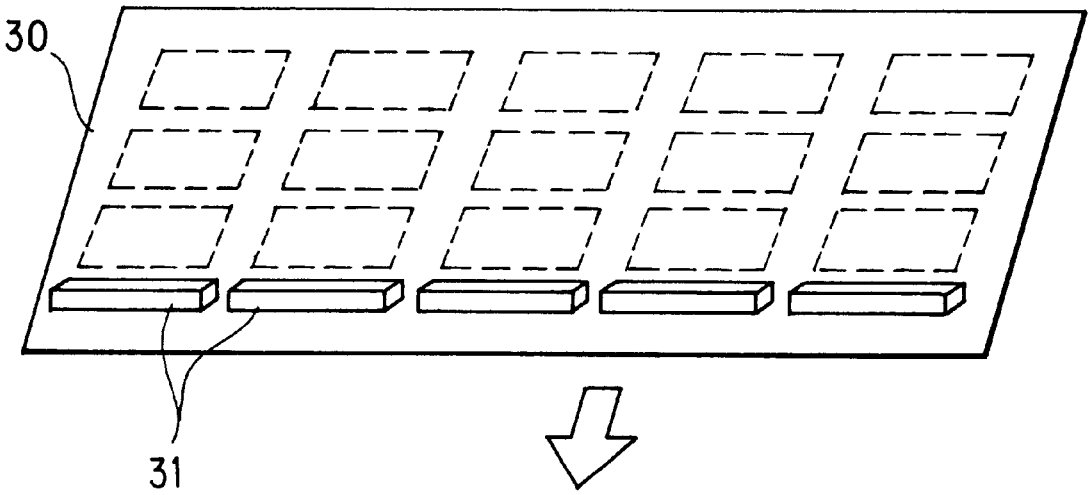
FIG. 3B shows an arrangement of the infrared ray image sensor.

As shown in FIG. 3B, if the security sheet 40 is large enough to arrange a plurality of security note sections (shown in broken-lines) in all directions, one direction along a conveyance direction and another direction perpendicular to the conveyance direction, the number of provided contact type line sensor units 31 may be coincident with the number of the lines of the security note sections of the security sheet 40 in order to detect each line of the security note sections by a respective contact type line sensor unit 31.

Each contact type line sensor unit 31 may employ an infrared ray lamp or LED as a light source and a CCD line sensor or a photo diode as a light receiving equipment.

For example, as shown in FIG. 3A, an infrared ray LED array 32 as a light source, an infrared ray photodiode array 33 and lens 34 are provided in a basket-type body 35. Infrared ray is irradiated towards a security sheet 30 from the infrared ray LED array 32, and an image of the security sheet 30 irradiated by the infrared ray is received through the lens 34 by the infrared ray photodiode 33.

A printing press with an infrared ray image sensor can be applicable to various machines, if infrared ray ink is utilized for printing.

The printing press is applicable to an offset printing press, an intaglio printing press, a number printing press, an automatic detecting device, and a machine for finishing a securities printed matters, and further applicable to a stamp printing press, a passport printing press, and a passport finishing machine.

The infrared ray image sensor is connected to a computer system (not shown) on line. The computer system comprises an image signal processing device, an identification device, and a display device.

A pattern of an image data stored in the computer through the infrared ray image sensor is compared to a pattern of a reference image data previously input to the identification device. The computer determines whether the pattern of the image data is within an acceptable dispersion range. If the pattern of the image data is not permissible, (outside the range) a detected printed matter is judged as a waste paper and a mark is printed on the printed matter. The printed matter is, then, discharged to a different container and/or an alarm is operated.

The reference image data is obtained by irradiating infrared ray on a securities printed matter, which is formally printed. The reference image data is memorized at a predetermined section of a memory device.

A scanned image of a sheet of a security sheet conveyed in a printing process is changed to a visible data as a still picture. The result of the scanned image can be displayed together with a comparison of the reference image and the scanned image.

Figure 1:
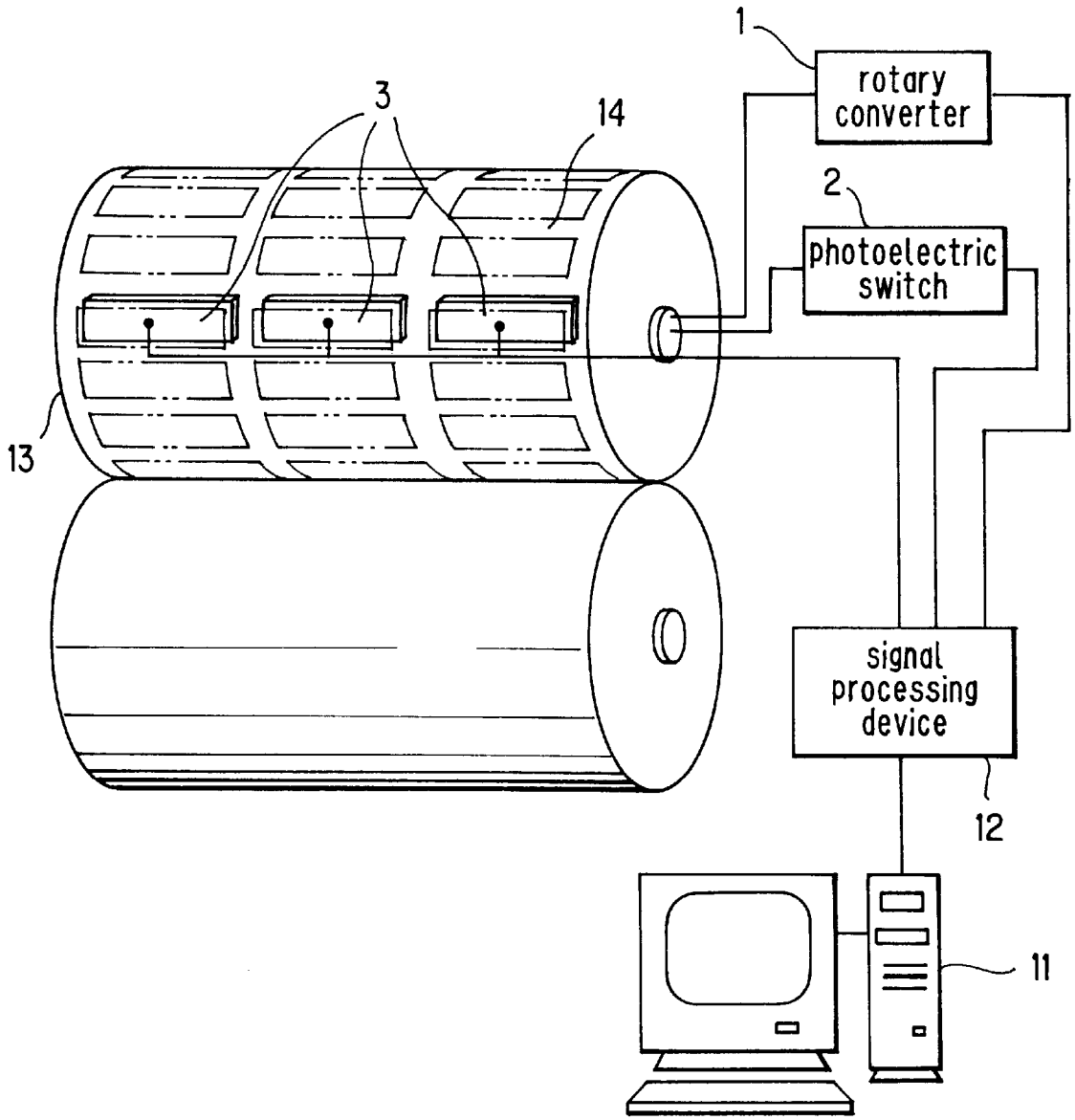
FIG. 1 shows a device for detecting a matter printed with infrared ray ink according to the present invention.
Figure 2:
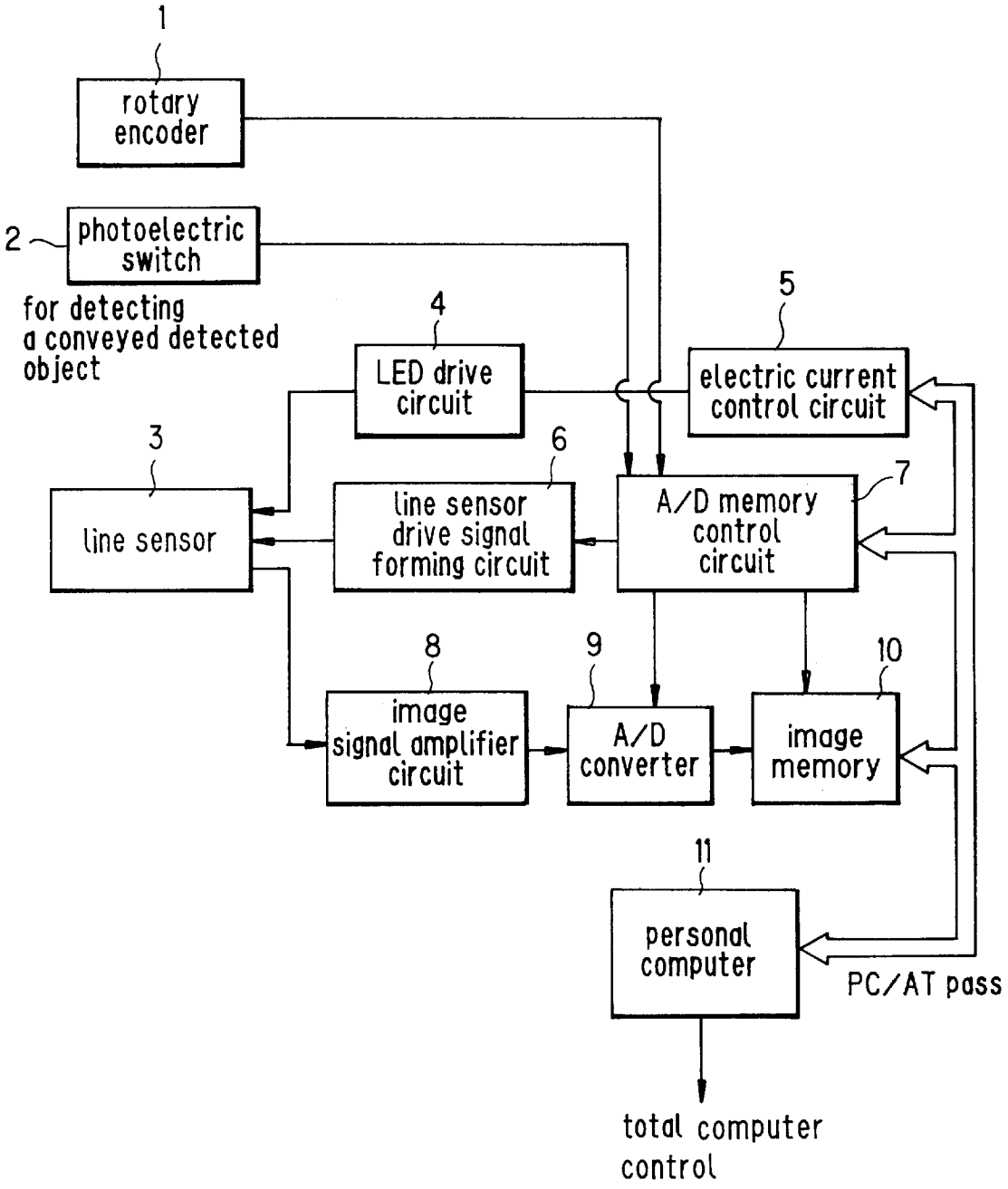
FIG. 2 is a block diagram showing a signal process of the embodiment according to the present invention.

One embodiment of a device for detecting a matter printed with infrared ray ink according to the present invention is shown in FIG. 1 and FIG. 2.

In the embodiment, as shown in the drawings, an intaglio printing press comprises a plurality of contact type line sensors 3, and the printer press is connected to a signal processing device 12 and a personal computer 11 in order to detect a security sheet 14 on line. In the embodiment, there are three lines of security note sections (herein after, it is referred as "detected object) arranged along a transverse direction with respect to a rotational direction of the impression cylinder 13.

Corresponding to each line of detected objects on the security sheet 14, a contact type line sensor 3 is provided. Each line sensor 3 is connected to the signal-processing device 12.

As described above, the contact type line sensor 3 comprises an infrared ray LED array, an optical element for forming an image, a photodiode array, and a picture signal control IC, detects an infrared ray image of the detected object and outputs signals in proportion to variable density of the image along time series.

A part of a detected area is a blank portion generally called as a margin portion where any image is not printed. A detected signal corresponding to the blank portion may be controlled at a constant level by electric current of the infrared LED controlled by the personal computer 11.

As shown in FIG. 2, the signal processing device 12 processes an image signal from each line sensor 3 in accordance with signals from the rotary encoder 1 and the photoelectric switch 2 and transports to the personal computer 11. The signal processing device 12 comprises a LED drive circuit 4, an electric current control circuit 5, a line sensor drive signal forming circuit 6, a A/D memory control circuit 7, an image signal amplifier circuit 8, an A/D converter 9, and an image memory 10.

Figures 6A, 6B, 6C, 6D, 6E, 6F, 6G, 6H:
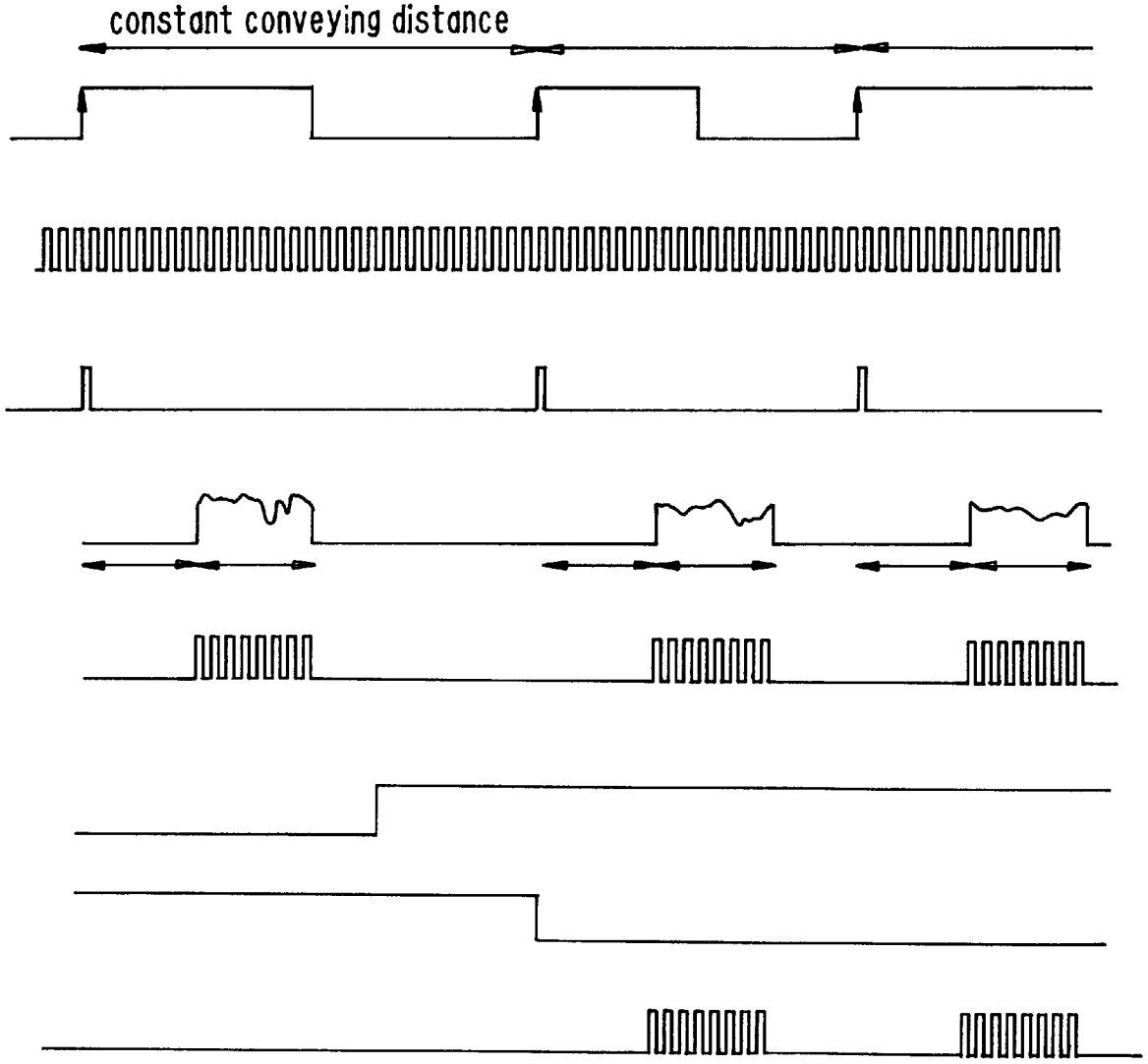
FIG. 6A through FIG. 6H shows a timing for generating a pulse/signal in an embodiment of the present invention, respectively.

The rotary encoder 1 is a device for outputting pulses as shown in FIG. 6A per the impression cylinder 13 rotating every predetermined angle regardless of time. As shown in FIG. 6C through FIG. 6E, these pulses are utilized to control a start timing of a scanning operation of each line sensor 3 and an actuating operation of the A/D converter 9. FIG. 6B shows a reference clock signal.

The photoelectric switch 2 outputs a signal as shown in FIG. 6F only when the detected object is conveyed into each line sensor 3. In accordance with the signal, as shown in FIG. 6G, an image signal is A/D converted and memorized in the image memory 10.

The LED drive circuit 4 drives the infrared LED in each line sensor 3 with the constant electric current.

The electric current control circuit 5 adjusts an amount of electric current applied to of the infrared LED in each line sensor in accordance with an instruction from the personal computer 11.

The line sensor drive signal forming circuit 6 generates a scanning start signal for driving an image signal control IC in each line sensor 3 and outputs it to each line sensor 3.

As shown in FIG. 6C, the scan start signal is output at a pulse rise time of the signal output from the rotary encoder 1. Outputting the scan start signal starts a scanning operation of each line sensor 3.

The A/D memory control circuit 7 generates an A/D conversion timing signal, as shown in FIG. 6E, based on the signal and the reference clock signal from the rotary encoder 1 and the photoelectric switch 2 and also generates a memorizing signal for memorizing in the image memory 10 as shown in FIG. 6H.

The image signal amplifier circuit 8 amplifies an infrared image signal (analog), as shown in FIG. 6D, output from each line sensor 3 corresponding to a scan start signal as shown in FIG. 6C.

A photodiode array of each line sensor 3 employs a flash exposure method for maintaining a charging period of occurred electrode at a constant period so that an amplitude of the image signal can become constant even if the scan start period is not constant.

The A/D converter 9 converts an infrared image signal from the image signal amplifier circuit 8 to an image data in accordance with an A/D conversion timing signal as shown in FIG. 6E.

The image memory 10 is a temporary storing memory for transporting the image data converted by the A/D converter 9 to the personal computer 11 and actuated by a memory allowable signal as shown in FIG. 6G and a reference clock signal as shown in FIG. 6B.

The personal computer 11 controls an emitting amount of the infrared LED in the each line sensor 3 (electric current control), compares a right (standard) image data previously stored as a standard value and an image of a detected object presently conveyed in view of printing density and printing position, and judges correct or wrong based on a predetermined allowable range. The result of the judgement is transported to a total control computer (not shown). If the detected object is judged as wrong, the detected object is recognized as a wasted paper. The security sheet 14 judged as a wasted paper may be marked by the well known method, discharged to a pile different from a pile for a correct one and/or an alarm is activated in order to distinguish the wrong one from the correct one.

A device for detecting a matter printed with infrared ray ink comprising the above elements, according to the present invention, takes an image data of a proper securities printed matter under infrared ray by the contact type line sensor 3 before a detecting process, memorizes the data as a standard value in a memory of the personal computer 11, and inputs/memorizes an allowable range as a standard value for judgment.

In the detecting process, an emitting amount of the infrared LED of the each line sensor 3 is determined, the security sheet 14 is supplied for printing. The sheet 14 is printed on the impression cylinder 13 while the impression cylinder 13 rotates and then an image of the each detected object on the security sheet 14 is taken by the each line sensor 3.

A detection by the each line sensor 3 may be operated in a period after starting the printing process and before finishing a discharging process or in a period of a process conveyed by a chain gripper as well as in the printing process.

Next, the image data taken in a conveying process is compared with to the image data previously stored as the standard value, and then the taken image data is judged as to whether it is within an allowable range. The result of the judgement is displayed at the display device (not shown) and transported to the total control computer. After finishing the detection, the result of the judgement is stored as a record and an intermediate process of the comparison and the operation are also stored.

Figure 5A:
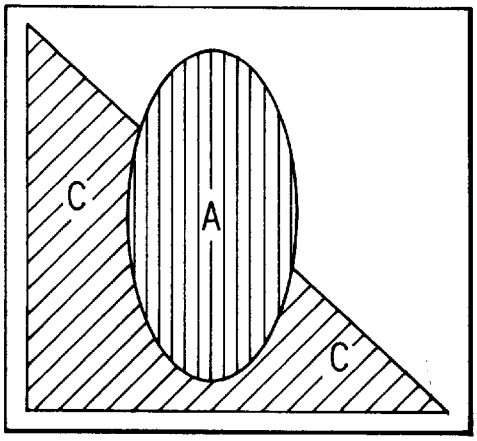
FIG. 5A shows a printing pattern of a securities printed matter under white light.
Figure 5B:
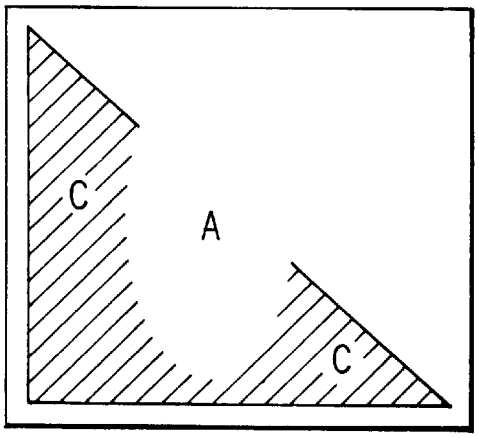
FIG. 5B shows a printing pattern of a securities printed matter under infrared ray.

For example, success and failure is judged based on images as shown in FIG. 5A and FIG. 5B.

At first, as shown in FIG. 5A, in a case that ink that reflects infrared ray is used at a portion A and ink which absorbs infrared ray is used at a portion C, as shown in FIG. 5B, the portion A is not detected and the portion C is only detected by each line sensor 3 of the embodiment. If all portions belong within their allowable regions, the security sheet is judged as correct.

As shown in FIG. 5A, in a case that each line sensor 3 can not distinguish the portion A and the portion C or the all portions do not belong to their allowable regions, a sheet is judged as wrong and a signal is output.

A comparison of the standard value of the image data and the detected value is operated as follows.

Figure 7A:
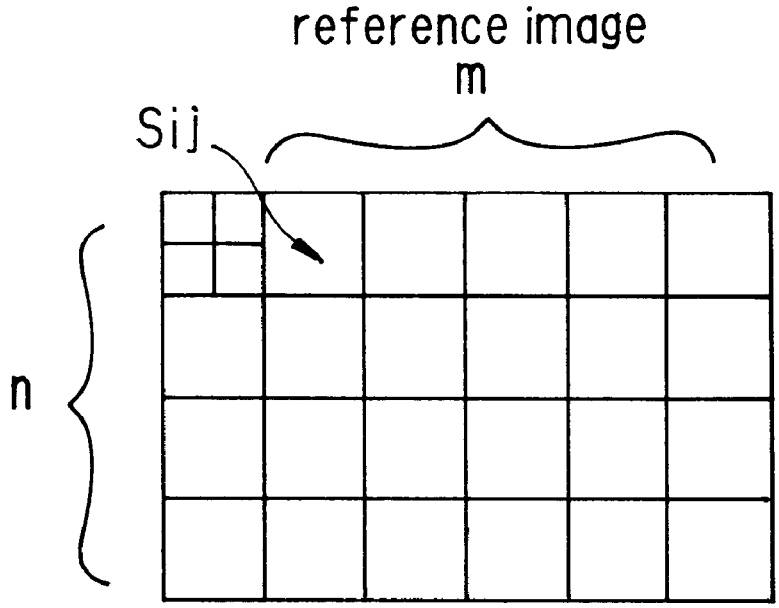
FIG. 7A shows divided blocks of a reference image.

(1) As shown in FIG. 7A, an image of a security sheet of a proper securities printed matter, previously detected, is divided to m×n blocks. A sum of the image data is computed by summing pixels of the each block and the data is stored as the standard value Sij. Number of the divided blocks depends on a printed matter.

Figure 7B:
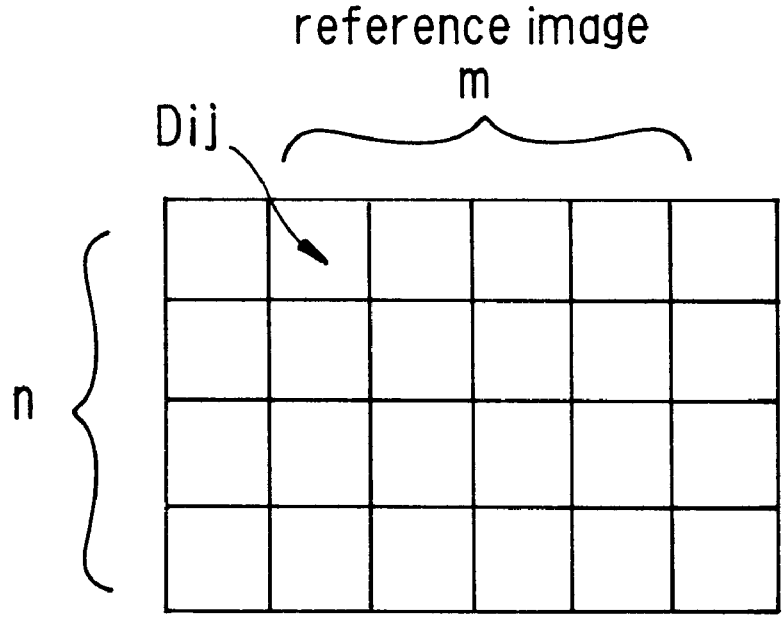
FIG. 7B shows divided blocks of a detected image.

(2) As shown in FIG. 7B, an image of a detected object obtained by each line sensor 3 is also divided to m×n blocks. The total image data is computed by summing pixels of the each block and the detected value Dij is stored.

(3) In accordance with a following equation 1, the standard value Sij and the detected value Dij are compared with respect to each block.

$$Cij=(Dij\sim Sij)/Sij \qquad 1;$$

wherein i=1−m, j=1~n.

(4) A result of the comparison is judged based on a judgment table (Tmin ij, Tmax ij) previously stored. If the result satisfies the following inequality 2, the detected object is judged as correct, and unless the result satisfies the inequality 2, the detected object is judged as wrong.

$$Tmin ij<Cij<Tmax\ ij \qquad 2$$

In the above described embodiment, even if a rotational speed of the impression cylinder for previously taking a standard value of a right security sheet and an actual rotational speed of the impression cylinder for actually detecting a printed security sheet are different, an output of a sensor is unnecessary to be adjusted.

As shown in FIG. 6, the line sensor 3 employs a photoelectric charging circuit in a flash exposure method for emitting a light source in a predetermined period simultaneously with a line sensor scan start signal so that a flash is always emitted in a constant charging period.

An output of an image is operated in the constant charging period by utilizing a leading edge (trailing edge) of a pulse of the rotary encoder 1 simultaneously rotating with the printing press.

Accordingly, in the line sensor 3 of the embodiment, according to the present invention, it is unnecessary to adjust the output due to speed variation.

A period of the pulses of the rotary encoder relates to a detect resolution.

In the above described embodiment, a detected object conveyed to each line sensor 3 is detected by a photoelectric switch 2. However, instead of the photoelectric switch 2, zero pulse of the rotary encoder 1 may be utilized to do the same operation if a timing of zero pulse (origin pulse) of the rotary encoder 1 is relatively coincident with a conveyance timing of a detected object to each line sensor.

As described above, the present invention provides a device for automatically detecting a securities printed matter printed with infrared ray ink of which a quality control can not be checked through the naked eyes under room light. Such a detection can be operated efficiently and improve a printing quality. The detection is not a sampling check. The entire printed matter can be checked reliably so that a reliance of the device can be improved in a market where a forgery check is strictly operated.

Although the present invention has been described in detail, the same is by way of illustration and example only and should not to be taken by way of limitation. The spirit and scope of the present invention are to be limited only by the terms of the appended claims.

What is claimed is:

1. A printing press for printing a printed matter with an infrared ray ink of which spectrum characteristics in an infrared region is different from spectrum characteristics under white light, said printing press, comprising:

infrared ray irradiating means for irradiating infrared ray towards said conveyed printed matter;

image data pick up means for obtaining data of an image of the printed matter, including a blank portion of the printed matter, irradiated by the infrared ray, the irradiated infrared ray irradiated by said infrared irradiating means being controlled based on the obtained data of the image corresponding to the blank portion;

memory means for previously memorizing data of an image of a standard printed matter, printed with the infrared ink, as a standard value by irradiating the infrared ray;

comparing means for comparing said data of the image of the standard printed matter and said data of the image obtained by said image data pick up means; and judgement means for judging whether a result of the comparison is within a predetermined range.

2. The device as claimed in claim 1, wherein said infrared ray ink is mixed with at least two kinds of ink having different absorption regions in an infrared region, respectively.

3. The device as claimed in claim 1, wherein said infrared ink includes at least two kinds of ink, both inks having the same reflective and absorptive characteristics in a visible light region and different characteristics in an infrared ray region.

4. The device as claimed in claim 1, further comprising:

conveyer means for conveying the printed matter in a predetermined direction, wherein said printed matter includes a plurality of sections along a direction perpendicular to the conveyance direction.

5. The device as claimed in claim 4, wherein said image data pick up means includes a plurality of contact type line sensors and each said contact type line sensor is arranged to obtain data representative of an image of one of said plurality of sections along the conveyance direction.

6. The device as claimed in claim 4, wherein said image data pick up means is an area sensor for obtaining data representative of the entire image of at least one of said plurality of sections at one time.

7. The device as claimed in claim 4 wherein said image data pick up means is a spot sensor for obtaining data representative of a partial image of one of said plurality of sections.

8. The device as claimed in claim 1, further comprising:

an impression cylinder, wherein said printing press is an intaglio printing press.

9. The device as claimed in claim 1, wherein said printed matter is printed securities.

10. A method of checking a quality of a printed matter printed with an infrared ray ink, comprising:

memorizing a first value representative of an image of a standard printed matter as a result of irradiating an infrared ray thereon;

irradiating the infrared ray on another printed matter;

detecting a second value representative of an image of the another printed matter, including a blank portion thereof, as a result of irradiating the infrared ray thereon;

controlling an amount of irradiation of the infrared ray based on the obtained data of the image corresponding to the blank portion;

comparing said first value and said second value;

determining whether a result of the comparison falls within a predetermined range; and generating a signal when the result falls outside the predetermined range.

* * * * *